United States Patent [19]

Fenne

[11] 3,941,282

[45] Mar. 2, 1976

[54] HYDRAULIC SYSTEM

[75] Inventor: Ivor Fenne, Greenford, England

[73] Assignee: C.A.V. Limited, Birmingham, England

[22] Filed: May 7, 1974

[21] Appl. No.: 467,822

[30] Foreign Application Priority Data

May 12, 1973 United Kingdom ..... 22719/73

[52] U.S. Cl. ..... 222/76; 417/322

[51] Int. Cl.[2] ..... F04B 41/06

[58] Field of Search ..... 222/333, 76; 417/322

[56] References Cited

UNITED STATES PATENTS

| | | | |
|---|---|---|---|
| 2,755,966 | 7/1956 | Lindars | 222/76 |
| 2,831,609 | 4/1958 | Montbriand et al. | 222/76 |
| 3,418,980 | 12/1968 | Benson | 417/322 X |
| 3,803,424 | 4/1974 | Smiley et al. | 417/322 |

*Primary Examiner*—Stanley H. Tollberg

*Attorney, Agent, or Firm*—Olson, Trexler, Wolters, Bushnell & Fosse, Ltd.

[57] ABSTRACT

A hydraulic system comprises an electrically controlled actuator element operable to initiate delivery of liquid. The system also includes a movable member the movement of which is representative of the amount of liquid delivered and sensing means is provided for detecting movement of the member. The sensing means provides a control signal which is arranged to effect a change in the state of the actuator element when the required quantity of liquid has been delivered.

3 Claims, 1 Drawing Figure

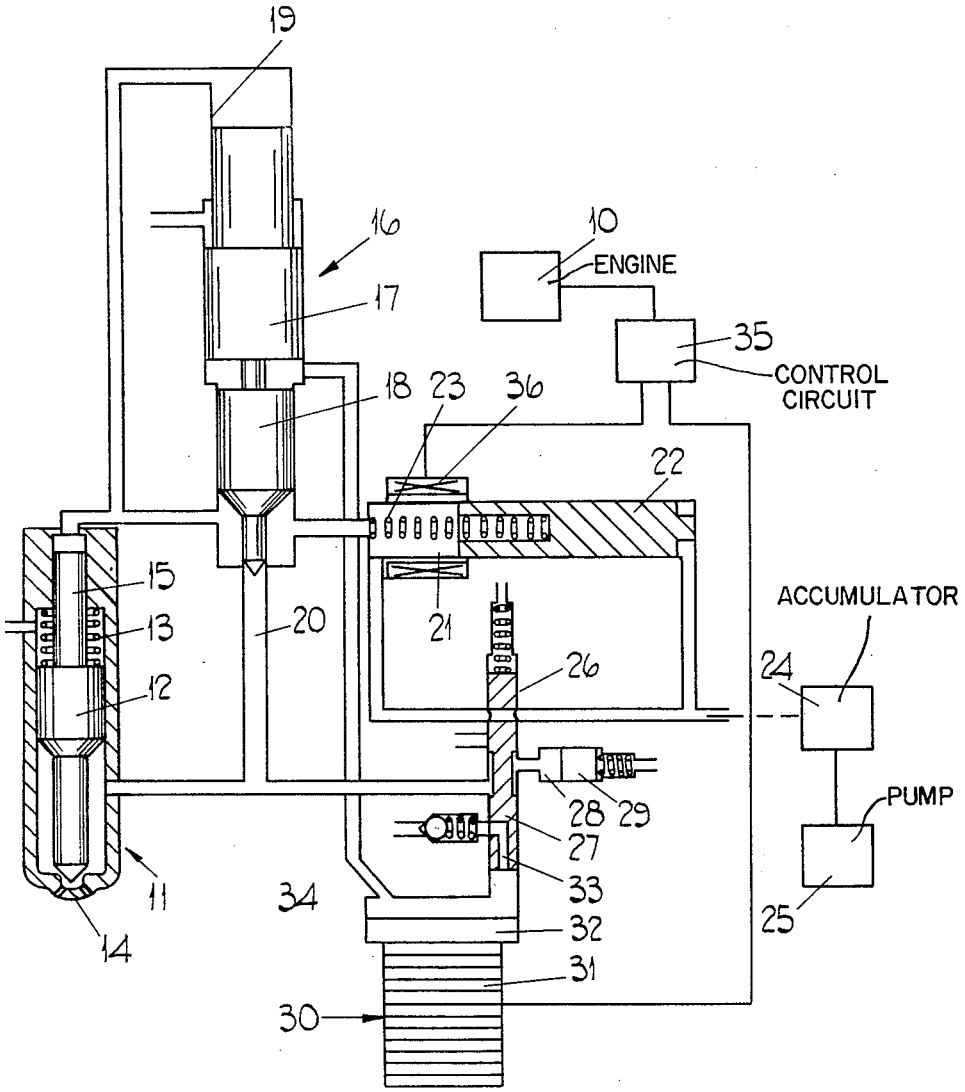
19
16
17
18
23
36
10
ENGINE
35
CONTROL CIRCUIT
22
15
13
12
20
21
26
ACCUMULATOR
24
PUMP
25
28
29
27
33
32
31
30
11
14
34

HYDRAULIC SYSTEM

This invention relates to hydraulic systems, and has for its object to provide such a system in a simple and convenient form.

A system in accordance with the invention comprises in combination, an electrically controlled actuator element operable to initiate delivery of liquid, a movable member the movement of which is representative of the amount of liquid delivered, and sensing means for detecting movement of said member, said sensing means providing a control signal arranged to effect a change in the state of the actuator element.

One example of a hydraulic system in accordance with the invention will now be described with reference to the accompanying drawing which shows in schematic outline, a fuel injection system for an internal combustion engine.

Referring to the drawing, there is provided an engine 10, one of the combustion chambers of which is supplied with fuel by means of an injection nozzle 11. The injection nozzle includes a differential valve 12, having a central portion of larger diameter than the end portions. The valve is loaded in one direction by means of a coiled compression spring 13, and the remote end of the valve member is shaped to co-operate with a seating thereby to control the flow of fuel through orifices 14 into the aforesaid combustion space. The other end of the valve member defines a piston 15, which is located within a cylinder and the space surrounding the spring 13 communicates with a drain.

Also provided is a valve 16 which includes a piston member 17 and a control valve member 18. The control valve member 18 is provided with an extension which abuts against the piston member 17. The piston member 17 has a stepped periphery, the wider portion contacting the extension and the narrower portion being contained within a cylinder 19 which is in communication with the cylinder containing the piston 15. The control valve member 18 is shaped to co-operate with a seating to control flow of fuel through a passage 20 which communicates with the end of the cylinder containing the valve member 12, remote from the spring 13. Moreover, the end of the cylinder 19 communicates with a space surrounding the end of the control valve member 18 remote from the piston member 17. This space is additionally in communication with one end of a cylinder 21.

The cylinder 21 contains a piston like member 22 which is biassed away from said one end of the cylinder 21 by means of a light coiled compression spring 23. The other end of the cylinder 21 communicates with an accumulator 24 in which fuel is stored under pressure, the fuel being supplied by a pump 25 conveniently actuated by the engine 10.

Also provided is a servo valve 26 which includes a spring loaded valve member 27. In the position shown, the valve member 27 permits communication between the opposite ends of the cylinder 21, but when in its alternative position as will be described, interrupts such communication. In addition, the valve member is provided with a groove which in the position shown, communicates with the passage 20, and places said passage in communication with one end of a cylinder 28 containing an unloading valve element 29, the latter being spring loaded. In the alternative position, the communication with the passage 20 is broken, and the cylinder 28 is placed in communication with a drain.

The end of the valve member 27 remote from the spring is subjected to a fluid pressure which is developed by an electrically controlled actuator element 30. In the particular example, this comprises a stack of piezo-electric crystals 31 which operate a piston 32 contained within a suitable cylinder. The aforesaid cylinder communicates with the bore which contains the valve member 27 and also with the space intermediate the piston member 17 and control valve member 18. Moreover, the valve member 27 is provided with a passage 33 which in the position shown communicates by way of a non-return valve 34 with a source of liquid fuel.

Electric power is supplied to the stack of piezo-electric crystals 31 by means of a control circuit indicated at 35. This control circuit receives signals indicative of the position of the engine, and also a further signal from a sensing coil 36 which provides a signal indicative of the position of the member 22.

The mode of operation of the system will now be described. As shown in the drawings, the various parts of the system have assumed the position which they adopt intermediate injections of fuel to the engine. When the system is required to inject fuel to the engine, a signal is provided by the control circuit 35 which effects expansion of the piezo-electric crystals 31.

As a result of this expansion, the piston 32 is moved upwardly as shown in the drawing, and this pressurises the fluid contained in the cylinder containing the piston 32. The pressure is applied to the valve member 27, and moves it against the action of the spring to its alternative position. In this position, the communication between the opposite ends of the cylinder 21 is broken, and the communication of the passage 20 with the cylinder 28 is also broken, the latter however being placed in communication with the drain, so that the valve member 29 moves under the action of its spring.

The pressure of fluid developed by the piston 32 is also applied intermediate the piston member 17 and control valve member 18. The application of such pressure results in axial movement of the piston member 17 and the control valve member 18 follows with the result that the passage 20 is opened to the end of the cylinder 21. When this occurs, fuel from the accumulator moves the member 22 against the action of its spring and fuel is displaced from the one end of the cylinder 21, and is applied to the end of the valve member 12 remote from the spring 13. As a result of this pressure, the valve member 12 lifts away from its seating, and fuel flow through the orifices 14 into the combustion chamber of the associated engine occurs. The flow of fuel continues until the member 22 has moved a predetermined extent, whereupon the signal supplied by the coil 36 to the control circuit 35 removes the electric supply from the stack of piezo-electric crystals 31. When this occurs, the fuel pressure between the piston member 17 and control valve member 18 falls, and these two components move under the action of the accumulator pressure applied to the piston member 17 so as to halt the flow of fuel through the passage 20. At substantially the same time the valve member 27 moves under the action of its spring to place the passage 20 in communication with the cylinder 28. The cylinder 28 can expand in volume owing to movement of the valve member 29 and thereby a rapid reduction in the pressure in the passage 20 and also in the space surrounding the narrower end of the valve member 12 remote from the spring, occurs. The accumulator pressure acting on the piston 15 therefore effects rapid closure of the valve member 12. In addition, the opposite ends of the cylinder 21 are placed in communication with each other so that the member 22 returns to the position shown under the action of the spring 23. Finally, any fluid which may have escaped from the cylinder containing the piston 32 and any of the cylinders or bores communicating therewith, is replaced by way of the non-return valve 34.

I claim:

1. An hydraulic system comprising a cylinder, a movable member located in said cylinder, a source of liquid under pressure, first and second conduit means connecting the ends respectively of said cylinder with said source of liquid, first valve means in said first conduit and operable to place the ends of said cylinder in communication with each other, resilient means acting on said movable member and operable when said valve means is open to move the member towards the one end of the cylinder connected to said second conduit, a fluid pressure generator, an electrically operated actuator element forming part of said generator, said first valve means including a surface acted upon by the fluid pressure developed by said generator when said actuator element is energised so as to develop a force to open said first valve means, a control circuit for said actuator, means responsive to the position of said movable member for providing a signal to said control circuit when said first valve means is in the closed position whereby when said member attains a predetermined position, said actuator element will be de-energized to allow said first valve to move to the open position, an outlet passage communicating with the other end of the cylinder, a control valve for controlling liquid flow through said outlet passage, said control valve including a control valve member subject to the pressure of liquid in said other end of the cylinder, said pressure acting on said valve member to open said control valve, said control valve further including means acting on said control valve member for applying to said control valve member a force greater than the force developed on the control valve member by the pressure in said other end of the cylinder, said means defining a further surface which can be subjected to the fluid pressure developed by said fluid pressure generator, whereby when fluid pressure is developed by said generator the force acting on said control valve member is reduced to the extent that the control valve member moves to allow fluid flow through said outlet passage, the volume of fluid flow depending upon the movement of said movable member.

2. A system according to claim 1 in which the means acting on the control valve comprises a stepped piston member slidable within a complementary cylinder, the narrower end of said cylinder communicating with said other end of the cylinder and the wider end of the stepped piston member defining said further surface and engaging said control valve member, the wider end of the stepped cylinder communicating with an output of said fluid pressure generator.

3. A system according to claim 2 including a further cylinder, a spring loaded unloading valve element located in said further cylinder and second valve means operable when said first valve means is in the open position to place said outlet passage downstream of the control valve in communication with said further cylinder.

* * * * *